United States Patent [19]

Otsuka et al.

[11] Patent Number: 4,931,153

[45] Date of Patent: Jun. 5, 1990

[54] ELECTROLYTIC TREATMENT OF RADIOACTIVE LIQUID WASTE TO REMOVE SODIUM

[75] Inventors: Katsuyuki Otsuka; Yoshiharu Takahashi, both of Tokai; Hideaki Tamai, Fukuoka, all of Japan

[73] Assignee: Doryokuro Kakunenryo Kaihatsu Jigyodan, Tokyo, Japan

[21] Appl. No.: 233,625

[22] Filed: Aug. 18, 1988

[30] Foreign Application Priority Data

Aug. 21, 1987 [JP] Japan ..... 62-207569

[51] Int. Cl.[5] ..... C25D 3/66

[52] U.S. Cl. ..... 204/39; 204/130; 204/140; 204/141.5

[58] Field of Search ..... 204/1.5, 68, 140, 141.5, 204/145 F, 130, 39

[56] References Cited

U.S. PATENT DOCUMENTS 4,191,620 3/1980 Young et al. ..... 204/99

4,290,863 9/1981 Nogueira et al. ..... 204/128

FOREIGN PATENT DOCUMENTS 2271302 12/1973 France ..... 204/68

*Primary Examiner*—John F. Niebling

*Assistant Examiner*—Kathryn Gorgos

*Attorney, Agent, or Firm*—Armstrong, Nikaido, Marmelstein, Kubovcik & Murray

[57] ABSTRACT

A process for electrolytically treating a radioactive liquid waste includes electrolyzing a radioactive liquid waste containing sodium compounds using mercury as a cathode in an electrolytic cell, separating the liquid waste into an amalgam of metals, inclusive of sodium, and residue, separating the metals including the sodium from the amalgam, purifying and reutilizing the metals, and recycling the mercury in the electrolytic cell.

3 Claims, 1 Drawing Sheet

ELECTROLYTIC TREATMENT OF RADIOACTIVE LIQUID WASTE TO REMOVE SODIUM

BACKGROUND OF THE INVENTION

This invention relates to the pretreatment of a radioactive liquid waste produced by reprocessing or generated by a light-water or breeder reactor, wherein the liquid waste contains mainly sodium compounds and is disposed in the form of a solid in a mixture with glass, asphalt, plastic or the like. More particularly, the invention relates to a process for electrolytically treating such a radioactive liquid waste for the purpose of recovering useful elements, such as sodium.

The high-level liquid waste produced by reprocessing or generated by a light-water or fast breeder reactor is a solution comprising 40% $Na_2O$ and 60% fissile material, actinides, corrosion products and the like. Conventionally, a glass-forming material is added to such high-level liquid waste and the mixture is subjected to a heating process to solidify the glass. Alternatively, the liquid waste is mixed with an asphalt or plastic material and solidified therewith and the resulting solid is discarded at a storage location. For examples of such prior art, see the specifications of Japanese Patent Publication (KOKOKU) Nos. 39-15100, 42-15519. In order to remove sodium compounds from these liquid wastes, processes have been proposed in which the high-level liquid wastes are heated to remove the sodium compounds by decomposition and vaporization.

However, it has been pointed out that the solidification processes using glass or the like are disadvantageous in that there is an undesirable increase in bulk owing to addition of the glass, etc. forming materials, and in that it is difficult to recover useful nucleides from the glass solid, or the like. It has also been pointed out that the process for decomposing, vaporizing and removing the sodium compounds by heating the high-level radioactive liquid waste also involves such problems as the need for high temperatures, the decomposition and vaporization of nucleides having low boiling points, and the complexity of the off-gas treatment system.

SUMMARY OF THE INVENTION

Accordingly, an object of the present invention is to provide a process for electrolytically treating a radioactive liquid waste through which sodium can be removed from a radioactive liquid waste containing sodium compounds, the amount of the waste to be treated can be reduced, elements having low boiling points can be handled without being vaporized thanks to treatment at comparatively low temperatures, the recovery of useful elements is facilitated, the treatment process readily enables use of methods other than glass solidification, and the volume of solids is greatly diminished.

According to the present invention, the foregoing object is attained by providing a process for electrolytically treating a radioactive liquid waste, which method comprises the steps of electrolyzing a radioactive liquid waste containing sodium compounds using mercury as a cathode, separating the liquid into an amalgam of metals, which include sodium, and residue, separating the metals including the sodium from the amalgam, purifying and reutilizing the metals, and recycling the mercury to an electrolytic cell.

In general, low-boiling metals, mainly sodium, tend to form amalgams by bonding with mercury. In accordance with the present invention, a radioactive liquid waste containing sodium compounds is electrolytically decomposed (electrolyzed) using mercury as a cathode, and the metals in the liquid waste, including sodium, are separated in the form of an amalgam. The metals including sodium are then separated from the amalgam and purified, and the mercury is recycled to the electrolytic bath. This makes it possible to recover the sodium in the form of an amalgam. Moreover, in comparison with the conventional process in which the high-level radioactive liquid waste is heated to remove the sodium compounds by decomposition and vaporization, the apparatus used in the invention is smaller in size, simpler, enables intermittent operation and does not require high temperatures. In addition, since the components contained in the liquid waste can be separated into an amalgam and residue, the amount of the waste to be treated can be greatly reduced. The invention also facilitates use of a solidification process other than glass solidification.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the invention will now be described in detail with reference to the drawings.

Figure 1:
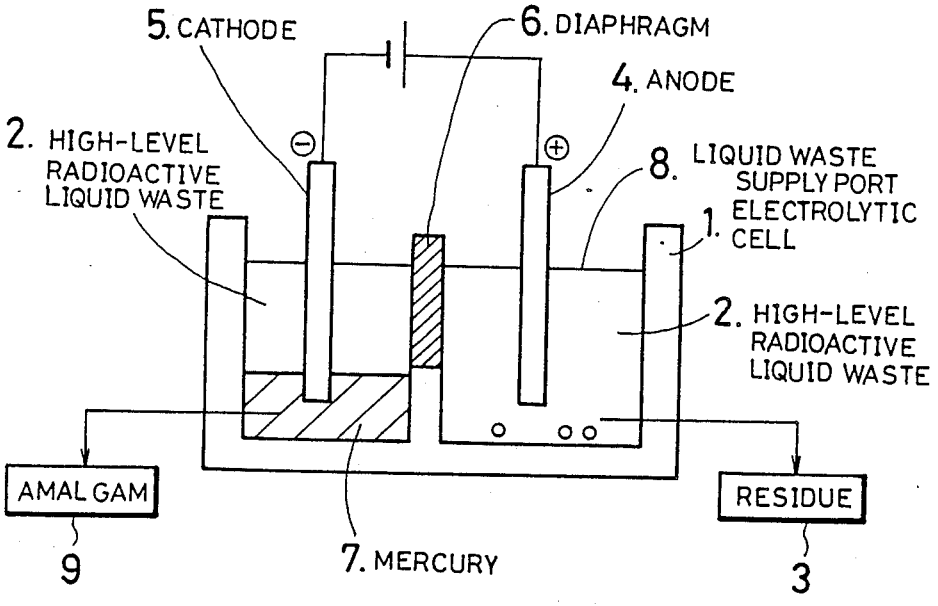
FIG. 1 is a sectional view illustrating an electrolytic cell used in the present invention.
Figure 2:
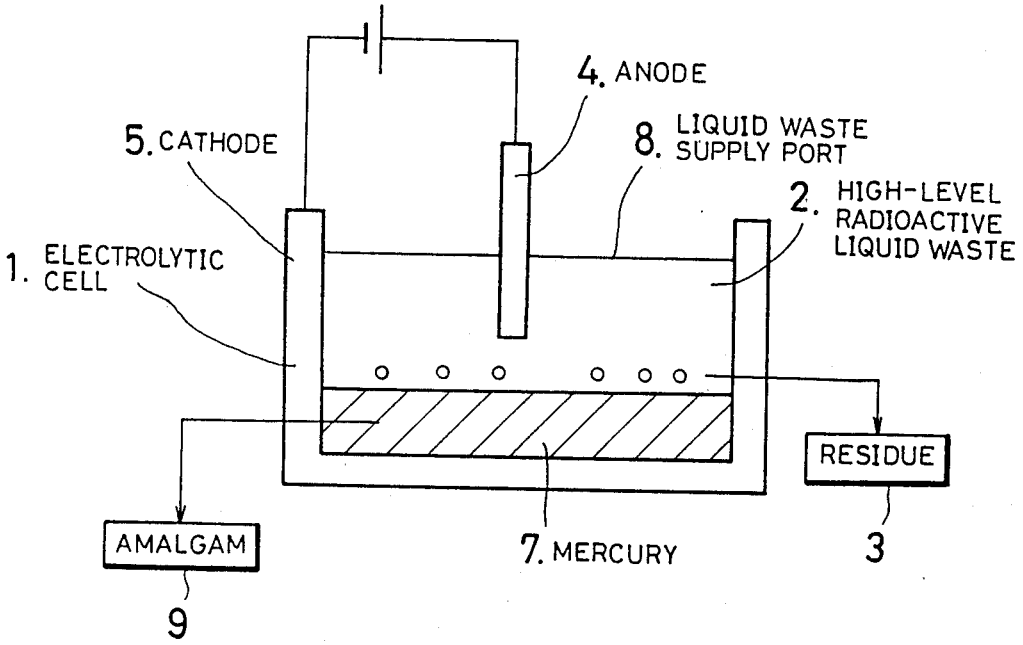
FIG. 2 is a sectional view illustrating another example of an electrolytic cell used in the present invention.

FIG. 1 is a sectional view illustrating an electrolytic cell used in the present invention, and FIG. 2 is a sectional view illustrating another example of an electrolytic cell usable in the present invention.

An electrolytic cell 1 includes an anode 4, a cathode 5, a diaphragm 6, mercury 7, and a port 8 from which the cell is supplied with a high-level radioactive liquid waste 2 to be treated. Numeral 3 denotes residue, and numeral 9 denotes an amalgam.

In the arrangement of FIG. 1, the high-level radioactive liquid waste 2 containing sodium compounds (sodium nitrate, sodium sulfate, etc.) to be electrolyzed is introduced into the electrolytic cell 1, which consists of an insulative material. The arrangement is such that additional liquid waste 2 can be supplied from the port 8 as required. The mercury 7 constitutes the principal portion of the cathode 5 and is accommodated in a partitioned portion of the electrolytic cell 1 to form a mercury bath in which the cathode 5 is inserted. Providing a diaphragm 6 is highly effective in preventing the precipitated residue 3, comprising mainly oxides and metals contained in the liquid waste, from migrating to the side of the cathode electrode 5.

When an electric current is passed through the electrolytic cell 1 constructed as set forth above, the low-boiling metal ions, inclusive of sodium, migrate toward the cathode 5 and form an amalgam 9 by bonding with the mercury. The amalgam 9 is extracted from the cell 1 and is delivered to further process steps for separation and purification of the metals, whereby the useful metals inclusive of sodium are recovered. The residue, on the other hand, is fed to a solidification process step.

FIG. 2 illustrates an arrangement in which the electrolytic cell 1 itself is utilized as a portion of the cathode. Mercury 7 is poured into the electrolytic cell 1, which in this case is electrically conductive, and the liquid waste 2 is introduced into the cell on top of the mercury 7. The anode 4 is secured in the liquid waste 2, and the electrolytic cell 1 serves as the cathode. When the cell is energized, the metal ions in the liquid waste 2 deposit on the mercury 7 so that an amalgam can be formed. Though a diaphragm is not shown in FIG. 2, one can be arranged between the anode 4 and the mercury 7 as required.

In the embodiment described above, a high-level radioactive liquid waste is treated. However, it goes without saying that medium- and low-level radioactive liquid wastes can be treated in the same manner as the high-level waste. In addition, the separation of the metals from the amalgam and the purification of the metals can be performed using well-known amalgam refining techniques.

By electrolyzing a radioactive liquid waste containing sodium compounds using mercury as a cathode, an amalgam of metals such as sodium can be separated from the liquid waste, and the sodium and other metals can in turn be separated from the amalgam, with the mercury being recycled in the electrolytic cell. Since sodium can be removed from the radioactive liquid waste containing the sodium compounds, the amount of waste to be treated can be reduced. Moreover, since treatment is carried out at comparatively low temperatures, low-boiling elements can be handled without being vaporized. The invention also facilitates the recovery of useful elements. Furthermore, a process other than glass solidification can readily be employed as the treatment process, and the volume of the solid produced can be greatly reduced.

As many apparently widely different embodiments of the present invention can be made without departing from the spirit and scope thereof, it is to be understood that the invention is not limited to the specific embodiments thereof except as defined in the appended claims.

What we claim is:

1. A process for electrolytically treating a radioactive liquid waste containing sodium compounds, comprising the steps of:

electrolyzing said radioactive liquid waste while using mercury as a cathode, so as to separate said liquid waste into an amalgam of metals including sodium and residue;

separating mercury from said amalgam; and solidifying said residue.

2. The process according to claim 1, wherein said electrolytic cell has a diaphragm disposed between said cathode and an anode for preventing precipitated residue, contained in the radioactive liquid waste, from migrating to said cathode.

3. A process of disposing of liquid, radioactive waste containing sodium, which comprises:

subjecting said waste to electrolysis in a cell, the cathode of which comprises mercury, whereby forming a sodium amalgam and also forming a liquid waste of substantially smaller volume;

separating sodium amalgam and residual liquid waste from said cell;

solidifying said separated residual liquid waste;

disposing of said solidified waste;

separating said sodium from said mercury by subjecting said amalgam to an elevated temperature sufficient to separate said mercury from said sodium, but insufficient to vaporize substantial quantities of other relatively low boiling elements;

recycling said separated mercury to an electrolytic cell for use in amalgamating additional sodium; and utilizing said sodium as a coolant.

* * * * *